United States Patent [19]

Cole et al.

[11] 4,084,644

[45] Apr. 18, 1978

[54] MOTOR GRADER OR THE LIKE WITH HYDRAULIC CONTROL SYSTEM FOR CIRCLE GEAR

[75] Inventors: Carroll R. Cole, Decatur; Joseph E. Dezelan, Western Springs; Gene B. Easterling, Decatur, all of Ill.

[73] Assignee: Caterpillar Tractor Co., Peoria, Ill.

[21] Appl. No.: 724,204

[22] Filed: Sep. 17, 1976

[51] Int. Cl.[2] ..... E02F 3/76

[52] U.S. Cl. ..... 172/796; 91/447; 172/719; 172/747

[58] Field of Search ..... 172/713, 719, 741, 742, 172/791, 792, 793, 794, 795, 796, 797, 747; 74/823, 824; 91/447, 448

[56] References Cited

U.S. PATENT DOCUMENTS

| | | | |
|---|---|---|---|
| 3,304,100 | 2/1967 | Long | 280/456 R |
| 3,381,587 | 5/1968 | Parquet | 91/447 X |
| 3,593,806 | 7/1971 | Gurries | 172/741 |
| 3,618,427 | 11/1971 | Schoepe | 74/824 |
| 3,943,824 | 3/1976 | Fletcher | 91/447 X |
| 3,980,000 | 9/1976 | Iijima et al. | 91/447 X |
| 3,984,910 | 10/1976 | Helton et al. | 172/713 X |
| 3,989,112 | 11/1976 | Cole et al. | 172/796 |
| 4,016,936 | 4/1977 | Easterling et al. | 172/796 |

*Primary Examiner*—Richard T. Stouffer
*Attorney, Agent, or Firm*—Phillips, Moore, Weissenberger, Lempio & Majestic

[57] ABSTRACT

A motor grader including a main frame mounted on steerable wheels, a drawbar frame mounted on the main frame, a working implement carried by a circle gear rotatably mounted on the drawbar frame and a hydraulic control circuit is described. An improvement in the control of the working implement is disclosed in which continuous downward force is exerted on the circle gear at all times during operation by hydraulic rams. Preferred embodiments of the invention are described wherein the force is exerted by hydraulic means including wear surfaces in contact with the circle gear and wherein the hydraulic control circuit is adapted to provide automatic operation.

10 Claims, 4 Drawing Figures

MOTOR GRADER OR THE LIKE WITH HYDRAULIC CONTROL SYSTEM FOR CIRCLE GEAR

BACKGROUND OF THE INVENTION

This invention relates to motor graders and more particularly to the improved control of the working implement or blade of a motor grader.

The working implement such as a blade or moldboard of a motor grader is conventionally mounted for a variety of adjustments in position relative to the frame in order to meet the requirements of each particular job which the motor grader is to perform. Thus, the working implement is mounted for elevational adjustment, cross-slope adjustment, lateral sliding adjustment, and rotational adjustment. The working implement is mounted on the main frame of the motor grader by means of a drawbar frame in order to provide for elevational adjustment and cross-slope adjustment and the working implement is mounted on the drawbar frame by means of a "circle gear" in the form of a ring-like structure rotatably mounted on the drawbar frame in order to provide for rotational adjustment with the lateral sliding adjustment being provided by the means which mounts the working implement on the circle gear. Preferably, the circle gear is locked in position with respect to the drawbar frame when it is not being rotated in order to prevent stress in the drive train thereto.

However, it has not been possible, according to the teaching of the prior art, to lock the elevational position of the working implement. In the first place, the rotatable mounting of the circle gear must be sufficiently loose when not locked against rotational adjustment to enable the desired rotational adjustment to be achieved. More importantly, the circle gear and its bearing support are peculiarly subject to wear during operation resulting in a further loosening of the fit therebetween and consequent elevational instability. Finally, the locks or brakes that have been used according to the teaching of the prior art have tended to result in elevational movement of the circle gear, when they are released or applied, through a distance approximating the amount of wear or looseness in the fit between the circle gear and its rotatable mounting means.

Modern motor graders use an automatic blade control device for reading the desired level from a reference grade line or wire and automatically adjusting the elevational position of the working implement in an attempt to maintain the reference level. However, such devices cannot compensate for changes in the elevational positioning of the working implement due to wear in the mating surfaces of the rotatable mounting means and any changes in the elevational positioning of the working implement which may occur during rotational adjustment of the working implement will result in departures from the reference grade level. Since tolerances as small as ⅛ inch (3.175 mm.) are now required in road grading operations, it will be seen that departures from the reference grade level during rotational adjustment of the working implement due to the wear inherent in the mounting structures or movement resulting from the operation of locking or braking devices to prevent rotational movement would be highly undesirable in such close tolerance work.

It is a primary object of this invention to provide an improved control for the working implement or blade of a motor grader or the like which will insure a consistent pre-selected elevational adjustment of the working implement at all times and particularly during rotational adjustment of the working implement.

SUMMARY OF THE INVENTION

Briefly, this invention provides an improvement in motor graders or the like including a main frame supported on steerable wheels, a drawbar frame, a working implement carried by a circle gear and a power source. The drawbar frame is adjustably mounted on the main frame and carries the circle gear thereunder. The circle gear comprises an annular body having parallel upper and lower planar surfaces and inner and outer peripheral surfaces. The working implement is carried by the circle gear adjacent the lower surface thereof and the drawbar structure includes guide shoes slidably engaging the lower surface of the circle gear and supporting it for rotation about its axis with the upper surface thereof adjacent the drawbar frame. The power source includes drive means operably connected to the circle gear for selective rotation of the circle gear and the working implement carried thereby. According to this invention, a hydraulic means is mounted on the drawbar frame and includes single acting piston means in continuous engagement with the upper surface of the circle gear. A hydraulic control system powered by the power source is adapted to apply a given hydraulic pressure to such piston means to force the piston means against the upper surface of the circle gear when the circle gear is being rotated by the drive means and to trap hydraulic fluid within the piston means when the circle gear is not being rotated by the drive means in order to rigidly oppose movement of the lower surface of the circle gear away from engagement with the guide shoes of the drawbar frame.

BRIEF DESCRIPTION OF DRAWING

The foregoing and other objects and features of the subject invention will be more fully understood from the following detailed description of a preferred embodiment thereof when read in conjunction with the attached drawings wherein.

DETAILED DESCRIPTION OF PREFERRED EMBODIMENT

Figure 1:
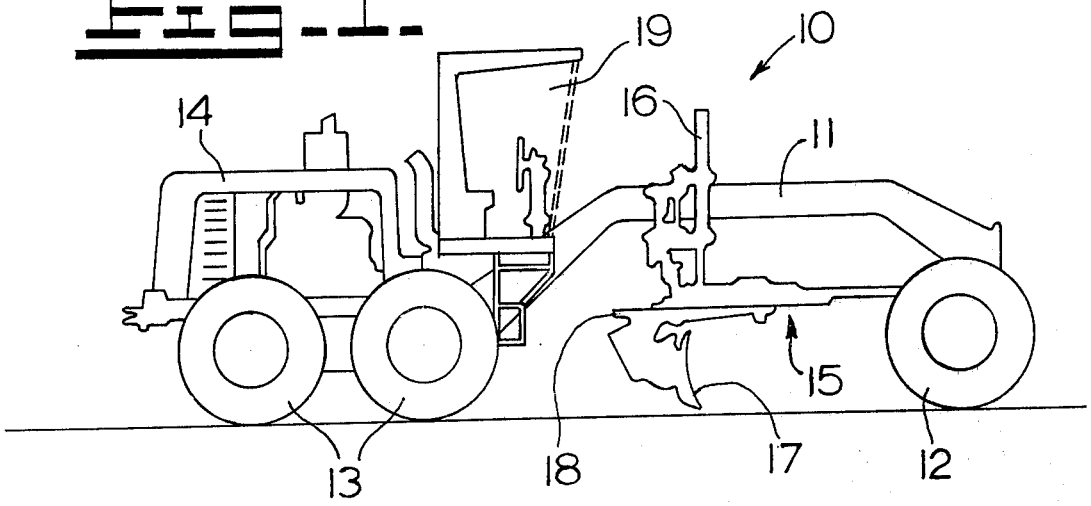
FIG. 1 is a simplified side view in elevation of a motor grader to which the subject application may be applied with advantage.

A motor grader 10 to which this invention is applicable is shown in simplified form in FIG. 1. Such motor grader 10 comprises an elongated arched frame 11 supported at the front end by a pair of steerable wheels 12 and at the rear end by one or more pairs of fixed driving wheels 13. An appropriate engine unit 14 is mounted on the frame 11 over the driving wheels 13 and supplies the motive power for the motor grader as well as the power for operating the various control systems thereof.

An elongated drawbar structure 15 is mounted under the arched portion of the frame 11 with one end connected to the forward end of the frame 11 by means of a universal joint (not shown in FIG. 1). The other end of the drawbar structure 15 is mounted on the arched portion of the frame 11 by appropriate control devices 16 such as hydraulic motors adapted to enable the drawbar structure 15 to be pivoted about the universal joint at the forward end thereof with respect to the frame 11.

A working implement such as an elongated blade 17 is mounted on a circle gear 18 which is in turn mounted for rotary movement about its axis on the end of the drawbar structure 15 remote from the universal joint by which such drawbar structure 15 is attached to the frame 11. Appropriate controls for the operation of the motor grader are located at an operator's station 19 mounted on the frame 11 intermediate the engine unit 14 and the arched portion of the frame and may include a cab adapted to protect the operator from the elements without obstructing the operator's view of the working implement or blade 17 and the front wheels 12 of the motor grader.

Figure 2:
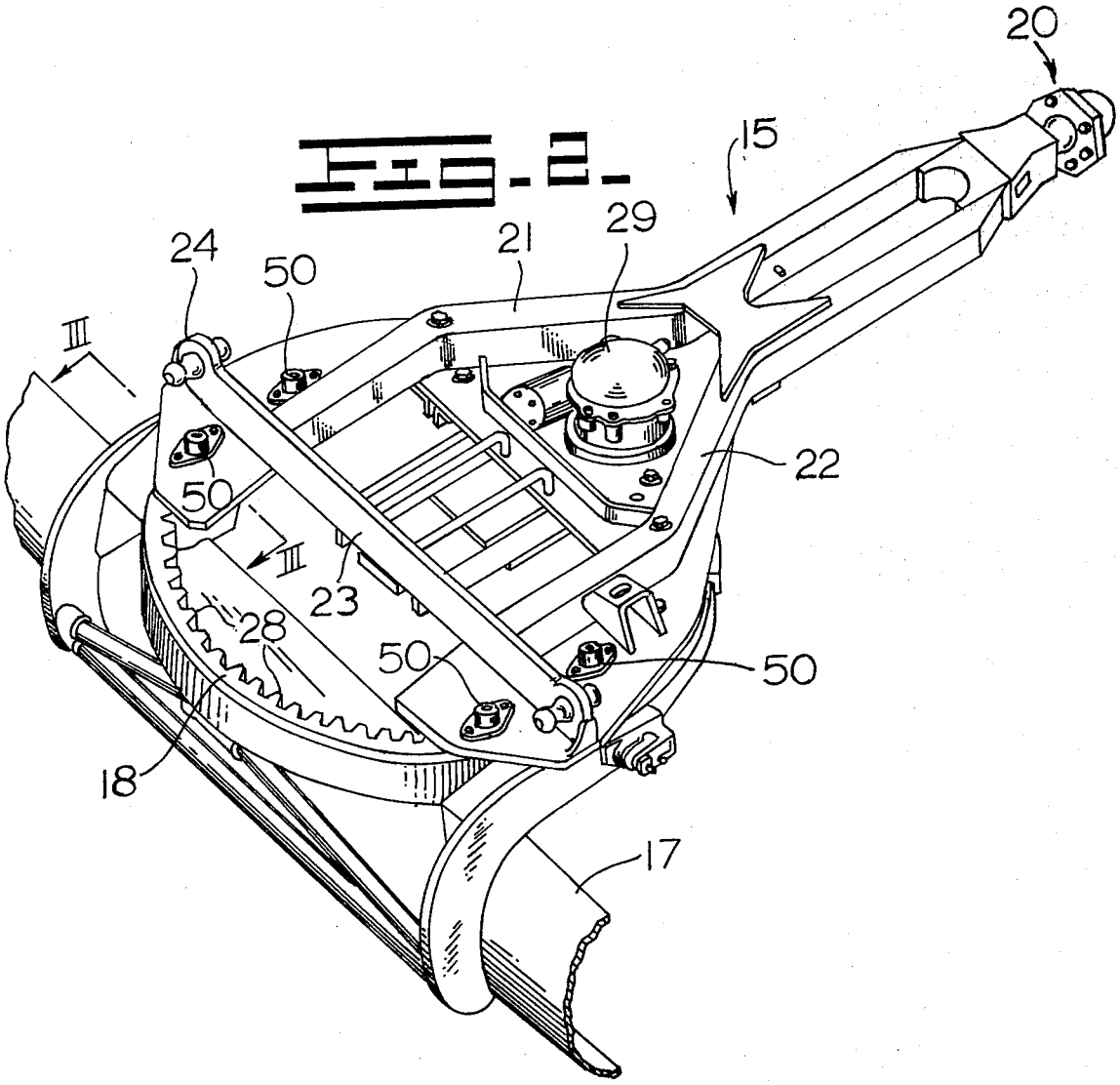
FIG. 2 is a perspective view of a drawbar frame including a circle gear and working implement mounted thereon and including the improvement of this invention.

FIG. 2 is an enlarged perspective view of the drawbar structure 15 showing the universal joint 20 by which it is attached to the frame 11 as well as the circle gear 18 and working implement or blade 17. It will be seen that the drawbar structure 15 comprises a pair of elongated girders 21 and 22 each having one end connected to the universal joint 20 and projecting therefrom to form a Y-shaped structure. A third girder 23 is connected across the free ends of the girders 21 and 22 and has projecting ends 24 which are provided with ball joint connecting means for attachment of the control devices 16 by which the free end of the drawbar structure 15 is mounted on the arched portion of the frame 11.

The circle gear 18 is rotatably mounted under the drawbar structure 15 by means of spaced shoe structures which are rigidly mounted on the drawbar structure 15 and slidably engage the lower surface of the circle gear 18. Preferably a pair of shoe structures are mounted at opposite ends of the girder 23 with a third shoe structure mounted between the girders 21 and 22. By such three-point support of the circle gear 18, the axis of the circle gear is fixed with respect to the free end of the drawbar structure 15 which may be raised and lowered with respect to the arched portion of the frame 11 or tilted with respect to the frame 11 by means of the control devices 16 attached to the ball joint connecting means at the ends 24 of the girder 23.

The inner periphery of the circle gear 18 is provided with gear teeth 28 adapted to engage an appropriate drive means 29 mounted on the drawbar structure 15. Such drive means 29 may comprise a worm or spur gear driven by an appropriate hydraulic motor, for example.

Thus, it will be seen that the working implement or blade 17 carried by the circle gear 18 may be raised and lowered or tilted with respect to the surface upon which the motor grader 10 is traveling by means of the control devices 16. In addition, the angle of the working implement or blade 17 with respect to the direction of travel of the motor grader 10 may be changed through rotation of the circle structure 18 by engagement of the drive means 29 with the gear teeth 28 at the inner periphery thereof.

Figure 3:
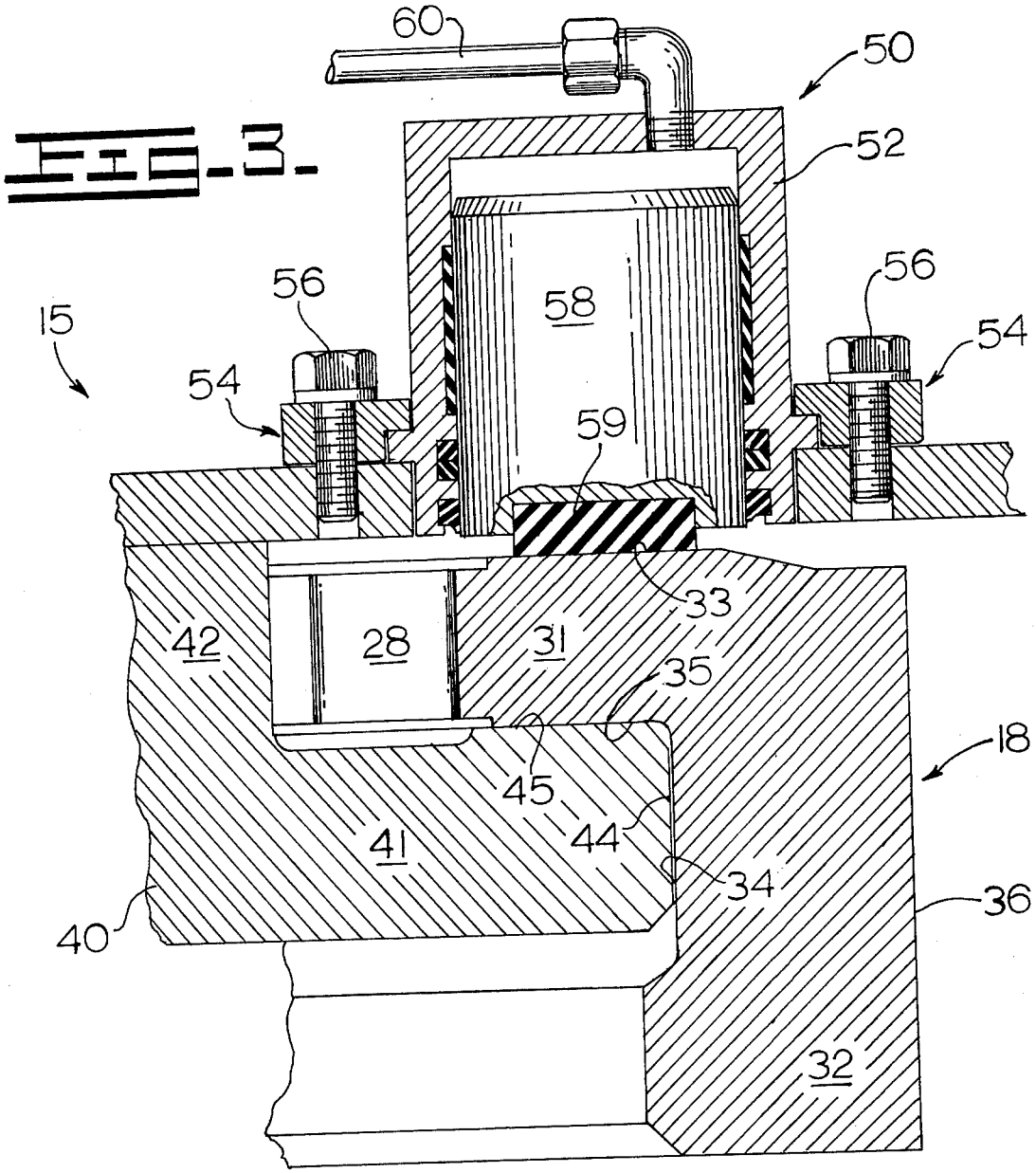
FIG. 3 is an enlarged fragmentary cross-sectional view taken along line III—III of FIG. 2 showing structural details of a preferred embodiment of this invention.

Referring to FIG. 3, it will be seen that the circle gear 18 is L-shaped in cross-section with one leg 31 of the L-shape providing parallel upper 33 and lower 35 planar surfaces and the other leg 32 of the L-shape providing inner 34 and outer 36 peripheral surfaces. The gear teeth 28 form an extension of the leg 31 and the lower surface 35 of the leg 31 slidably engages the guide shoes 40 by which the circle gear 18 is mounted on the drawbar frame 15.

As shown in FIG. 3, the guide shoes 40 are also L-shaped in cross-section having one leg 41 projecting radially outward to provide a curved guiding surface 44 at the free end thereof for engagement as required with the inner peripheral surface 34 of the leg 32 of the ring gear 18 and a planar surface 45 for supporting engagement with the surface 35 of the leg 31 of the ring gear 18. The free end of the other leg 42 of the guide shoe 40 is rigidly fixed to the drawbar frame as by bolting or other appropriate means (not shown).

As shown in FIG. 3, the circle gear 18 is supported on the shoe 40 with the upper planar surface 33 of the ring gear spaced below the under side of the drawbar frame 15. According to this invention, a hydraulic means is provided for holding the lower planar surface 35 of the circle gear 18 in constant engagement with the upper planar surface 45 of the shoe 40 against forces which may be exerted on the circle gear 18 during operation that would tend to lift the circle gear 18 upwardly toward the drawbar frame 15. As shown in FIG. 3, such hydraulic means comprises a single acting hydraulic ram 50 mounted on the drawbar frame 15 over the upper planar surface 33 of the leg 31 of the ring gear 18. The housing 52 of the ram 50 may be rigidly fixed to the drawbar frame 15 by means of an appropriate flange and collar arrangement 54 held in place by bolts 56 for example. The movable piston 58 of the ram 50 is adapted to project through the drawbar frame 15 and to be forced against the upper planar surface 33 of the leg 31 of the circle gear 18. According to the preferred embodiment of this invention, the projecting end of the piston 58 is provided with a wear surface for engagement with the upper planar surface 33 of the circle gear 18 as by means of an insert 59 made of non-ferrous bearing material such as a brass compound, a lead compound or a plastic compound such as ultra high molecular weight polyethylenes, polyolefins, polyamides, fluoroplastics or acetals.

According to the preferred embodiment of this invention hydraulic fluid at a given pressure is applied to the single acting hydraulic ram 50 through an appropriate hydraulic line 60 whenever the circle gear 18 is being rotated by the drive motor 29. Such given hydraulic pressure will tend to hold the lower planar surface 35 of the circle gear in engagement with the upper surface 45 of the shoes 40 against forces which may tend to lift the circle gear 18 toward the drawbar frame 15 but must not be so high as to result in permanent deformation of the insert 59.

When the rotation of the circle gear 18 has been completed, the hydraulic fluid within the ram structure 50 is trapped according to this invention and prevented from escaping through the hydraulic line 60 thus tending to maintain the hydraulic pressure within the ram structure 50. Since the hydraulic fluid is incompressible and since it cannot escape from the ram structure 50, the ring gear 18 will be held rigidly against any forces which may be exerted on the ring gear 18 during operation tending to lift the lower planar surface 35 thereof out of engagement with the supporting surface 45 of the shoe 40 thereby maintaining the elevational setting of the circle gear 18 and working implement 17 supported thereby with respect to the drawbar frame 15 at all times.

In order to avoid permanent deformation of the insert material 59 and yet provide sufficient total force to resist upward forces on the circle gear 18 normally encountered in operation, it is desirable to use a plurality of spaced rams 50 as best shown in FIG. 2. The insert material will, of course, wear away during operation, however, as shown in FIG. 3, the structure of the ram 50 and its mounting 54, 56 is very simple and the insert 59 thereof may be quickly and easily replaced whenever wearing of the insert 59 makes it necessary or desirable to do so.

The intentional wearing of the insert 59 will tend to reduce the undesirable wearing of the abutting surfaces 35 and 45 of the circle gear 18 and shoes 40, respectively. Since the hydraulic pressure applied to the rams 50 is renewed whenever the circle gear 18 is rotated, the wearing of the insert 59 will be periodically and automatically compensated. Thus, although the control including the ram 50 according to this invention does not provide a means for locking the circle gear against rotation about its axis, it does insure that a selected elevational location of the circle gear will be maintained regardless of the rotational locking means used.

As best shown in FIG. 2, preferred embodiments of this invention include a plurality of hydraulic rams 50 mounted on the drawbar frame in alignment with more than one of the guide shoes 40. Thus, as shown in FIG. 2, a pair of hydraulic rams 50 are mounted on the drawbar frame 15 in alignment with each of the shoes located at opposite ends of the girder 23. A larger number of hydraulic rams 50 could be used and certain of them could be aligned with the guide shoe which is located between the girders 21 and 22 of the drawbar frame 15. According to this invention, all of the single acting hydraulic rams 50 are operated in parallel by a common hydraulic control as fully described below. The hydraulic lines 60 by which the rams 50 are connected to the hydraulic control have been omitted from FIG. 2 for simplicity of illustration.

Figure 4:
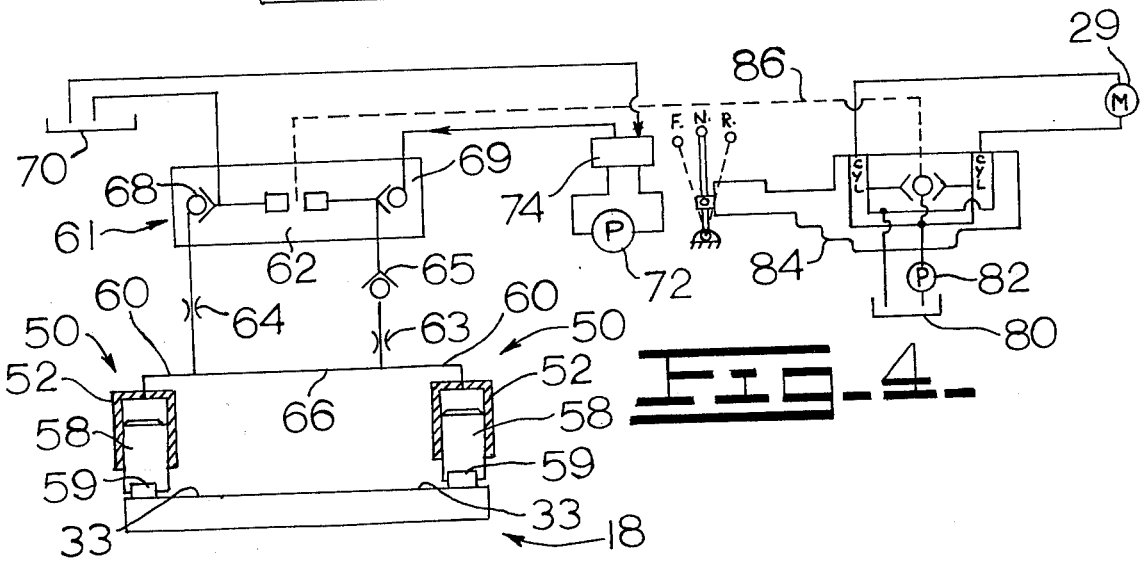
FIG. 4 is a schematic representation of the hydraulic circuit of a preferred embodiment of this invention.

Referring to FIG. 4, a hydraulic control circuit 61 according to a preferred embodiment of this invention is shown schematically together with hydraulic lines 60 connecting it to two single acting rams 50 shown schematically with their housings 52 in cross-section and the pistons 58 thereof urging insert members 59 against the upper planar surface 33 of a circle gear 18 which is also shown schematically.

As shown in FIG. 4, the control circuit 61 includes a dual controllable check valve 62, a first orifice 63, a second orifice 64 and an ordinary check valve 65. The outlet of the orifice 63 is connected to the inlet of the orifice 64 through a hydraulic line 66 and the hydraulic line 60 communicating with the hydraulic rams 50 are also connected to the hydraulic line 66. According to this invention, the relative size of the orifices 63 and 64 are selected to provide the desired hydraulic pressure in the line 66 when the dual controllable check valve 62 is actuated to pass hydraulic fluid during rotation of the circle gear 18. Thus, the outlet of the orifice 64 is connected through one element 68 of the dual controllable check valve 62 to a reservoir 70 and the inlet of the other orifice 63 is connected through the conventional check valve 65 and the other element 69 of the dual controllable check valve 62 to a source of hydraulic fluid under pressure including a high volume pump 72 operated by the power source of the motor grader 10. For example, the pump 72 may be a part of the steering circuit 74 conventionally used on motor graders 10 and capable of providing a large volume flow of hydraulic fluid at a high pressure. Since the desired given pressure in the rams 50 must be low enough to avoid permanent deformation of the insert members 59 and since a relatively small volume of hydraulic fluid flow will be required to operate the rams 50, the first orifice 63 may be quite small and the second orifice 64 somewhat larger. The maximum pressure present in the hydraulic line 66 and thus in the lines 60 and rams 50 will be a function of the relative size of the orifices 63 and 64 when the dual controllable check valve 62 is actuated.

When the dual controllable check valve 62 is not actuated, the first element 68 thereof will isolate the outlet of the orifice 64 from the reservoir 70 and the other element 69 thereof will isolate the ordinary check valve 65 and inlet of the orifice 63 from the source of hydraulic fluid under pressure including pump 72. It will be noted that the check valve 65 and the element 68 of the dual controllable check valve 62 will both act to prevent hydraulic fluid from leaving the rams 50 and hydraulic lines 60 and 66 thus tending to trap hydraulic fluid within the rams 50 at or close to the desired given pressure. Thus the pistons 58 of the rams 50 will rigidly oppose any forces which tend to move the circle gear 18 upwardly as shown in FIG. 4.

The element 69 of the dual controllable check valve 62 is adapted to prevent the flow of hydraulic fluid from the pump 72 into the control circuit 61 when the dual controllable check valve is not actuated. This not only prevents any possibility of the build-up of pressures in the rams 50 above the desired pressure but also prevents the loss of hydraulic fluid from the steering circuit if one of the hydraulic lines 60,.66 should rupture when the dual valve 62 is not actuated.

As shown in FIG. 4, the dual controllable check valve 62 may be automatically operated by the same control which actuates the drive means 29 (shown schematically in FIG. 4) for rotating the circle gear 18. Thus, as shown in FIG. 4, the drive means may be a hydraulic motor having one side connected to a reservoir 80 and the other side connected to the output of a pump 82 through a three-position four-way manually controllable valve 84. The valve 84 may include means for providing hydraulic fluid at a pilot pressure to the dual controllable check valve 62 as indicated by the dotted line 86. Thus, whenever the valve 84 is manually operated to rotate the circle gear 18 in either direction, a pilot pressure will be applied to the valve 62 to actuate the elements 68 and 69 thereof and allow the flow of hydraulic fluid from the pump 72 and steering circuit 74 through the check valve 65, orifice 63, conduit 66 and orifice 64. Whenever the valve 84 is manually moved to its neutral position the pilot pressure will be vented to the reservoir and the elements 68 and 69 of the dual controllable check valve 62 will close.

It is believed that those skilled in the art will make obvious changes in the control circuitry for operating the rams 50 in accordance with the teaching of this invention. For example, electrical or mechanical means could be used in place of the pilot pressure indicated by dotted line 86 to automatically operate the dual controllable check valve means 62 whenever the circle ring 18 is being rotated. However, it is necessary that the control circuit 61 be adapted to actuate the single acting rams 50 periodically and that the pressure of the hydraulic fluid as applied to the rams not exceed the value which would produce permanent deformation of the insert members 59 if applied over an extended period of time. It is, of course, possible that very high fluid pressure of short time duration will occur within the rams 50 due to upward forces exerted on the working implement 17 and circle gear 18 in operation when the dual controllable check valve 62 is not actuated and fluid is trapped in such rams 50. However, the inserts 59 are capable of withstanding high pressures for short periods of time without permanent deformation and any such forces may be distributed among a plurality of spaced rams 50 even though the force is localized with respect to the circle gear.

What is claimed is:

1. In a motor grader or the like including a main frame supported on wheels, a drawbar frame, a working implement carried by a circle gear and a power source; said drawbar frame being adjustably mounted on said main frame, said circle gear comprising an annular body having parallel upper and lower planar surfaces and inner and outer peripheral surfaces, and said working implement being carried by said circle gear adjacent said lower surface thereof; said drawbar frame including guide shoes slidably engaging said lower surface of said circle gear and supporting said circle gear with said upper surface of said circle gear adjacent said drawbar frame for rotation of said circle gear about the axis thereof, and said power source including drive means operably connected to said circle gear for selective rotation of said circle gear and said working implement carried thereby; the improvement comprising hydraulic ram means mounted on said drawbar frame including single acting piston means in continuous engagement with said upper surface of said circle gear and a hydraulic control system powered by pump means driven by said power source and supplied by a fluid reservoir, said hydraulic control system comprising means to apply a given hydraulic pressure to said hydraulic ram means to force said piston means against said upper surface of said circle gear when said circle gear is being rotated by said drive means and means within said hydraulic control system and spaced from said pump means to trap hydraulic fluid within said hydraulic ram means to continue to apply hydraulic pressure to said hydraulic ram means to cause said piston means to rigidly oppose movement of said lower surface of said circle gear away from said engagement with said guide shoes when said circle gear is not being rotated by said drive means.

2. The improvement in a motor grader or the like as claimed in claim 1 wherein said piston means includes a wear surface in engagement with said upper surface of said circle gear.

3. The improvement in a motor grader or the like as claimed in claim 1 wherein said piston means is provided with an insert projecting from the end of said piston means into engagement with said upper surface of said circle gear.

4. The improvement in a motor grader or the like as claimed in claim 3 wherein said insert is made of a nonferrous bearing material.

5. The improvement in a motor grader or the like as claimed in claim 3 wherein said insert is made of a material selected from the group consisting of brass compounds, lead compounds and ultra high molecular weight plastic compounds.

6. The improvement in a motor grader or the like as claimed in claim 1 wherein said means to apply a given hydraulic pressure comprises a first orifice of given size, a second orifice of larger size, means hydraulically connecting said first orifice to said pump means, means hydraulically connecting said second orifice to said reservoir, and means hydraulically connecting said first and said second orifices to each other and to said single acting hydraulic ram means.

7. The improvement in a motor grader or the like as claimed in claim 6 wherein said means hydraulically connecting said first orifice to said pump means includes a check valve adapted to prevent flow of fluid from said hydraulic ram means through said first orifice and said means hydraulically connecting said second orifice to said reservoir includes a controllable check valve adapted to selectively prevent flow of fluid from said hydraulic ram means through said second orifice.

8. The improvement in a motor grader or the like as claimed in claim 7 wherein said means hydraulically connecting said first orifice to said pump means includes a further controllable check valve adapted to selectively prevent flow of fluid to said hydraulic ram means through said first orifice.

9. The improvement in a motor grader or the like as claimed in claim 8 including means for simultaneously and automatically actuating said controllable check valve to allow flow of fluid from said hydraulic ram through said second orifice and said further controllable check valve to allow flow of fluid to said hydraulic ram means through said first orifice whenever said drive means is actuated for rotation of said circle gear.

10. The improvement in a motor grader or the like as claimed in claim 9 wherein a plurality of said hydraulic ram means are spaced from each other over said upper surface of said circle gear with the piston means thereof in continuous engagement with said upper surface and said means hydraulically connecting said first and second orifices to each other is hydraulically connected to each of said plurality of said hydraulic ram means.

* * * * *